US006257331B1

(12) United States Patent
Blount et al.

(10) Patent No.: US 6,257,331 B1
(45) Date of Patent: Jul. 10, 2001

(54) DOWNHOLE SETTING TOOL

(75) Inventors: Curtis G. Blount, Wasilla; David D. Hearn, Anchorage, both of AK (US)

(73) Assignee: Atlantic Richfield Company, Plano, TX (US)

( * ) Notice: Subject to any disclaimer, the term of this patent is extended or adjusted under 35 U.S.C. 154(b) by 0 days.

(21) Appl. No.: 09/362,607

(22) Filed: Jul. 28, 1999

(51) Int. Cl.[7] ..... E21B 23/04; E21B 23/06
(52) U.S. Cl. ..... 166/125; 166/123
(58) Field of Search ..... 166/63, 117.6, 166/381, 382, 383, 125, 181, 183, 123

(56) References Cited

U.S. PATENT DOCUMENTS 3,186,485 * 6/1965 Owen ..... 166/63
3,776,307 * 12/1973 Young ..... 166/125
4,773,478 * 9/1988 Streich ..... 166/120

* cited by examiner

*Primary Examiner*—David Bagnell
*Assistant Examiner*—Kamal Dawelbeit
(74) *Attorney, Agent, or Firm*—Drude Faulconer

(57) ABSTRACT

A downhole assembly for setting a well tool (e.g. packer) comprising a setting tool which has a draw rod made in two portions which are slidably connected to allow relative movement therebetween. The upper portion is releasably latched to the well tool wherein the weight of the well tool is effectively supported by the workstring rather than the draw rod during positioning of the assembly. Upon actuation of the setting tool, the upper portion is released from the well tool thereby allowing movement between the portions to switch the weight of the well tool to the draw rod during the setting of the well tool. By effectively unloading the draw rod during positioning of the assembly, the assembly can be retrieved if necessary without inadvertently setting the well tool or shearing the draw rod.

14 Claims, 2 Drawing Sheets

DOWNHOLE SETTING TOOL

DESCRIPTION

1. Technical Field

The present invention relates to a downhole assembly used in the positioning and setting of well tools within a wellbore and in one aspect relates to a downhole assembly for positioning and setting a well tool, e.g. packer, within a wellbore wherein the assembly is releasably latched to and is supported by the workstring (e.g. e-line, wire line, coiled tubing, etc.) until the tool has been positioned within the wellbore and is ready to be set.

2. Background

As will be understood in the art, there are instances during the completion and/or production of a well where it may become necessary to lower and set a well tool in the wellbore in order to carry out a particular operation. Such well tools include permanent packers, bridge plugs, etc. and are well known in the art. The well tool is carried on the lower end of a "setting tool" which, in turn, is manipulated to set the well tool once it has been lowered and properly positioned within the wellbore. As will be understood in the art, the setting tool may be actuated in a variety of ways, e.g. motor-driven screw carried by the setting tool, etc., or, as is often the case, it is hydraulically actuated.

A typical setting tool which is hydraulically actuated is one which is comprised of a housing having a "draw rod" extending therethrough. The draw rod is connected at its lower end to the well tool and at its upper end to the lower end of the work string (e.g. wireline, regular or coiled tubing, etc.) which, in turn, is used to lower the setting tool-well tool assembly into the wellbore. Once the assembly is properly positioned within the wellbore, the hydraulic setting tool is actuated by forcing fluid into a chamber within said housing which, in turn, drives the housing downward relative to the draw rod and into contact with the well tool to set slips, etc. on the well tool while at the same time the draw rod is held in position by the workstring. The continued relative movement between the housing and the draw rod will cause shear pins in the tool to fail or the draw rod, itself, to fail at a predetermined, weak point whereby the workstring and the setting tool can then be retrieved to the surface while leaving the set well tool in the wellbore.

While this procedure has proved effective in most applications, the possibly always exists that the well tool may become stuck with the wellbore as it is being lowered into position. With known setting tools, this can create a problem in that the draw rod of the setting is effectively connected directly to and fully supports the well tool. Accordingly, if the tool becomes stuck or it is desired to raise the tool before it is set, any upward force from the workstring is applied directly to the draw rod. If the well tool becomes stuck or wedged within the wellbore, the shear pins in the assembly and/or the draw rod can shear at its weak point, thereby leaving a partially-set, well tool at the wrong position within the wellbore. As will be understood, this can result in considerable downtime and added expense in correcting this problem.

SUMMARY OF THE INVENTION

The present invention provides a downhole assembly for setting a well tool (e.g. packer, plug, etc.) within a wellbore wherein the setting tool of the assembly includes a draw rod which is made in two portions which are slidably connected to allow relative movement therebetween. The draw rod is releasably latched in an unloaded position as the assembly is lowered and positioned within the wellbore so that the well tool of the assembly cannot be set inadvertently and can be retrieved before the well tool is set without risk of shearing the draw rod.

More specifically, the downhole assembly of the present invention is comprised of a setting tool having a draw rod which, in turn, has an upper portion and a lower portion which are slidably connected to allow relative movement therebetween. The upper portion is connected to a workstring (e.g. e-line, wire line, tubing, etc.) and the lower portion is connected to the well tool.

The present assembly includes an adapter section which, in turn, includes latch means for releasably latching the upper portion of the draw rod to the well tool whereby any upward and/or downward force from the workstring is applied to the well tool through the adapter section and not through the draw rod thereby avoiding the inadvertent setting of the well tool as the assembly is raised or lowered in the wellbore. Preferably, the latch means is comprised of a collet which is attached to the upper portion of the draw rod. The collet has a plurality of fingers which are normally biased into contact with a fishing neck on the well tool to releasably latch the upper portion to the well tool.

The fingers are held in their latched position by an internal collar on the lower end of the housing of the setting tool when the housing is in a first position, i.e. as the downhole assembly is run into the wellbore. When the setting tool is actuated, the housing is moved to a second position wherein the collar on the housing moves out of contact with said fingers thereby releasing said fingers from their latched position.

The upper portion of the draw rod is comprised of a mandrel which is slidably mounted in the upper portion of the housing and has a piston thereon which, in effect, cooperates with a shoulder within said housing to form a chamber within said housing. Upon actuation of the setting tool, a non-compressible fluid (e.g. hydraulic fluid) is flowed into the second chamber to move the housing from its first or latched position to its second or unlatched position. The setting tool can be actuated in the same manner as are several other known setting tools of this type By releasably latching the upper portion of the draw rod to the well tool through the adapter section, the lower portion of the draw rod is "unloaded" and is isolated from the forces in the workstring during the positioning of the downhole assembly. This effectively connects the workstring directly to the well tool so that if the downhole assembly becomes stuck in the wellbore or it has to be raised before it has reached its destination, it can be retrieved by the workstring without inadvertently shearing the draw rod or leaving a stuck well tool in the wellbore.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
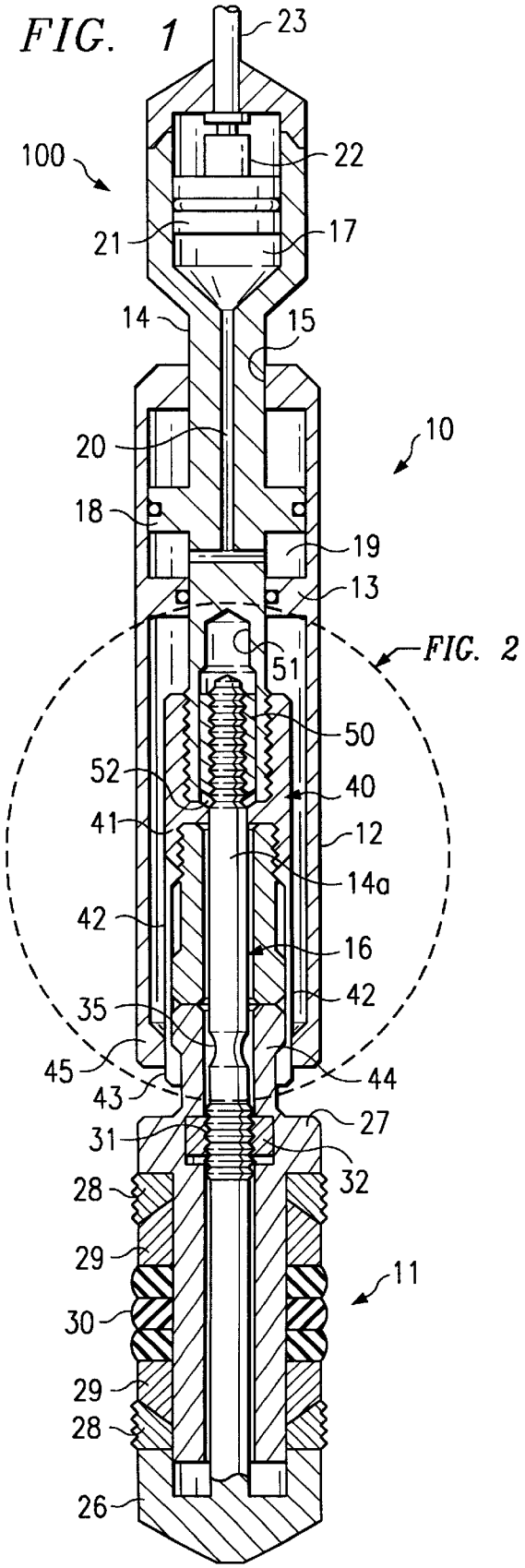
FIG. 1 is a sectional view of the downhole assembly of the present invention including a setting tool and a well tool which is to be set in a wellbore wherein said well tool is releasably latched to setting tool as the assembly is lowered and positioned within a wellbore.

Referring more particularly to the drawings, FIG. 1 illustrates the downhole assembly 100 of the present invention which is comprised of a setting tool 10 and a well tool 11 which is to be set in a wellbore (not shown). Well tool 11 is illustrated as being a typical, well known, permanent packer but it should be recognized that other known well tools of this general type, e.g. bridge plugs, retrievable packers, etc., can also be set with the present invention.

Setting tool 10 is illustrated as one which is basically similar to other known commercially-available setting tools of this type. Setting tool 10 is comprised of a housing 12 which has an internal collar 13 or the like intermediate its ends which effectively forms a piston on the housing for a purpose described later. A mandrel 14 is slidably mounted through bore 15 in the upper end of housing 12 and extends through collar 13 within the housing. The upper end of mandrel 14 is connected to workstring 23 which, in turn, extends to the surface and which is used to raise and lower the assembly into and out of a wellbore. While workstring 23 is illustrated herein as being an "e-line" (i.e. a line having electrical conductors therein), it should be recognized that the workstring may also be common wireline, regular or coiled tubing (not shown), or the like.

Mandrel 14 has an internal chamber 17 near its upper end and a shoulder 18 thereon which is positioned above collar 13 to form chamber 19 within the housing 12. Mandrel 14 also has a fluid passage 20 therein to provide fluid communication between chambers 17 and 19 for a purpose described later. Chamber 17 in mandrel 14 has a piston 21 slidably mounted therein and that portion of chamber 17 below piston 21, passage 20, and chamber 19 are all filled with a non-compressible fluid (e.g. hydraulic fluid) for a purpose described below. As illustrated, an explosive charge 22 is positioned within chamber 17 above piston 21 and is one which can be detonated by an electrical impulse through work string 23 where workstring 23 is an e-line or by other techniques as will be discussed below.

Draw rod 16 is comprised of an upper portion, i.e. mandrel 14 and a lower portion (i.e. rod 14*a*). Rod 14*a* has a sleeve 50 threaded onto its upper end which, in turn, is slidably positioned within recess 51 in the lower end of mandrel 14. Sleeve 50 is threaded onto rod 14*a* so as to leave a slight clearance 52 (FIG. 1) between the bottom of sleeve 50 and the top of the internal surface of collet 41 thereby allowing for relative movement therebetween. Clearance 51 will be present when the setting tool is in its latched positioned and draw rod 16 is "unloaded" as shown in FIG. 1. Rod 14*a* is connected at its lower end to a nose element 26 of well tool 11.

As illustrated, well tool 11 is a simplified illustration of a typical "permanent packer" which is commercially-available from a number of sources. As shown, packer 11 is comprised of a body 27 on which upper and lower sets of slips 28, expanders 29, and compressible packing elements 30 are mounted for relative movement thereon. The usual shear pins, detents, and the like which hold the slips, expanders, etc. in position on body 27 until they are to be set have not been shown for the sake of clarity. Rod 14*a* has a short length of ratchet teeth 31 thereon which cooperates with ratchet jaws or lock ring 32 in body 27 to allow rod 14*a* to move upward with respect to body 27 but which prevent relative downward movement of the rod to thereby lock the well tool 11 in its set position. Rod 14*a* also has a reduced section (e.g. "weak point" 35) thereon for a purpose described below.

Figure 4:
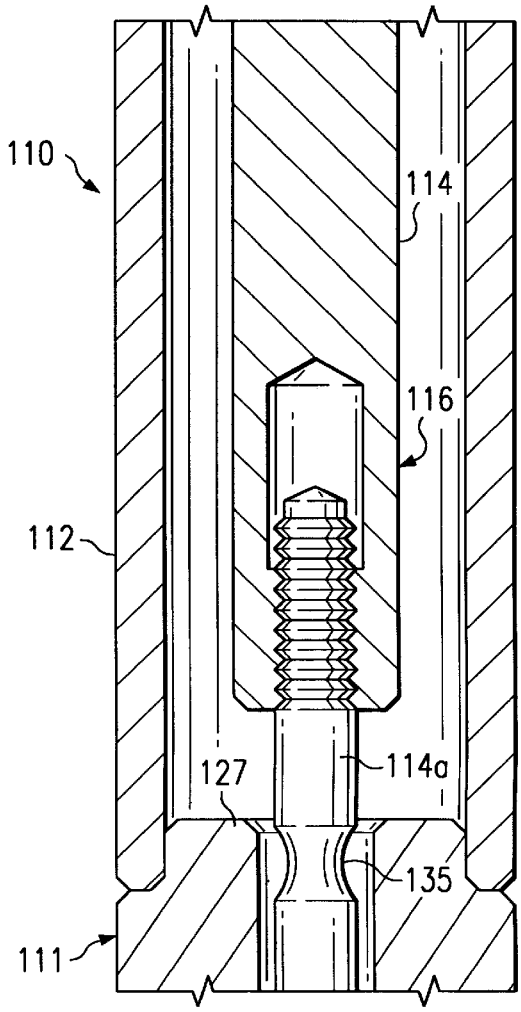
FIG. 4 (PRIOR ART)
FIG. 4 is a sectional view of a portion of a prior art downhole assembly of the type shown in FIG. 2, illustrating the prior art connection between the setting tool and the well tool to be set.

The basic construction of the downhole assembly 100, as described up to this point, is similar to that of prior art downhole assemblies of this general type except for the present draw rod 16. In the prior art assemblies, the draw rod is effectively a single rod which supports the weight of the well tool at all times during placement and setting of the well tool. That is, as seen in FIG. 4, the upper portion (mandrel 114) of prior art draw rod 116 in the prior art setting tool 110 is directly connected to the lower portion (rod 114*a*) by threads or the like thereby effectively forming an integral rod which, in turn, supports the entire weight of the well tool 111 as the downhole assembly is lowered or raised and set in a wellbore. Further, the lower end of housing 112 sits directly on body 127 of the well tool 111 so that when the setting tool is actuated, the housing 112 immediately begins to push downward against body 127 while draw rod 116 holds the well tool in position during the setting of the well tool 110.

Unfortunately, however, if the downhole assembly becomes stuck in the wellbore or it has to be retrieved before it reaches its destination, then any and all of the workstring forces are continuously applied on integral draw rod 114*a*. When the lifting force exceeds the strength of rod 114*a*, the rod will shear at its weak section 135 or the shear pins (not shown), holding the slips in place, may fail whereupon the well tool 111 will set thereby leaving the well tool stuck in the wellbore at a undesired location. As will be understood, this results in downtime and added expense which adversely affect economics of the well.

Again referring to FIG. 1, in accordance with the present invention, an adapter section 40 is positioned between draw rod 16 and the body 27 of well tool 11 which releasably latches the upper portion of the draw rod (i.e. mandrel 14), hence workstring 23, directly to the well tool until the downhole assembly has been lowered and is in position for the well tool 11 to be set. By effectively attaching the well tool 11 directly to the workstring, draw string 16 will remain any relative movement between mandrel 14 and rod 14*a* is prevented thereby allowing the downhole assembly to be raised when necessary without inadvertently setting the well tool or prematurely shearing the draw rod as might be the case in the known, prior art assemblies of this type.

Figure 2:
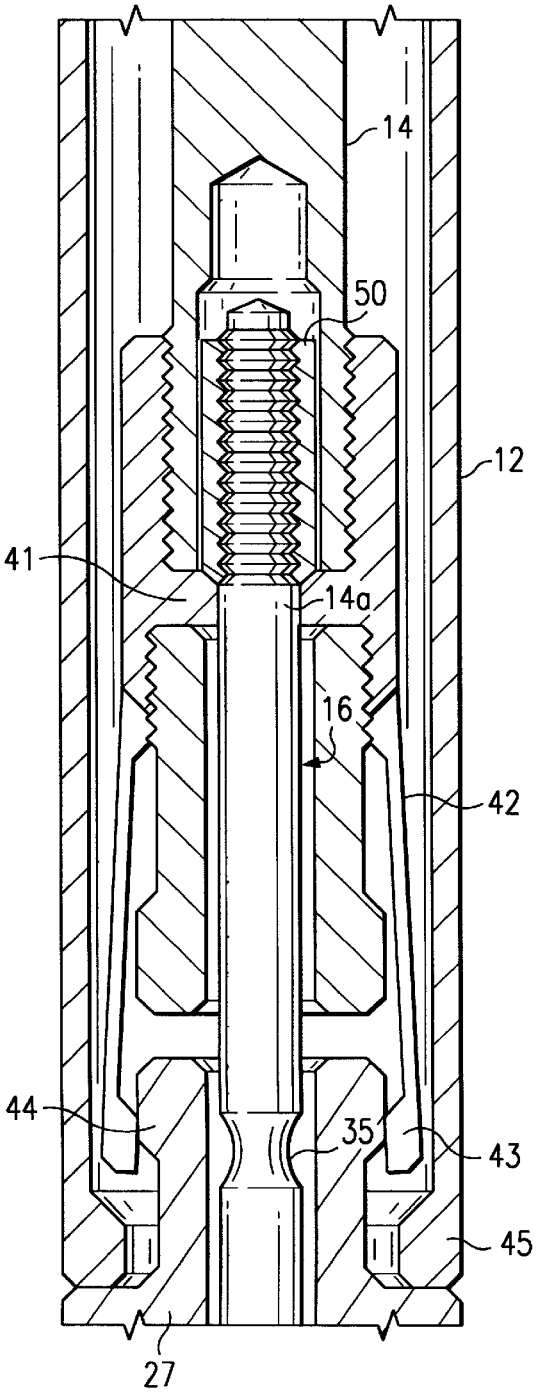
FIG. 2 is an enlarged, sectional view taken along lines 2—2 of FIG. 1 showing the downhole assembly of FIG. 1 wherein the well tool has been unlatched from the setting tool.
Figure 3:
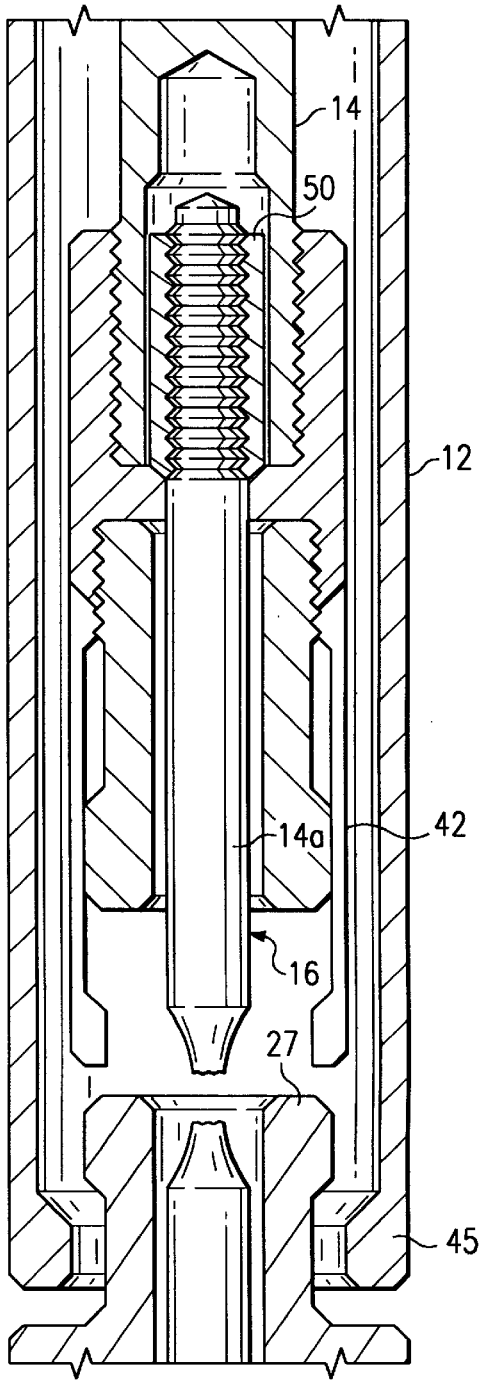
FIG. 3 is an enlarged, sectional view similar to FIG. 2 showing the downhole assembly of FIG. 1 after the well tool has been set and the draw rod of the setting tool has been sheared.

More specifically, adapter section 40 is comprised of a collet 41 which is connected to the outer surface of lower end of mandrel 14 by threads or the like. Collet 41 has a plurality of inwardly-biased, fingers 42 which, in turn, have detents 43 on their lower ends. Detents 43 are biased inward to engage the underside of fishing neck 44 on the upper end of body 27 of tool 11. An internal shoulder 45 on housing 12 contacts and holds fingers 42 inwardly to maintain detents 43 in a latched position when said housing is in its first position (FIG. 1) to thereby releasably latch the collet 41, hence mandrel 14 and workstring 23, to the body 27 of well tool 11. As will be more fully discussed below, when setting tool 10 is actuated, housing 12 is moved to a second position (FIG. 2) thereby releasing the detents and allowing relative movement between mandrel 14 and rod 14*a* to close the gap 52 within recess 51, see FIG. 1. As can be seen in FIGS. 2 and 3, this relative movement brings sleeve 50 on rod 14*a* into contact with the internal surface of collet 41 to "load" draw rod 16 whereby force can, for the first time, now be transmitted from between mandrel 14 and rod 14*a*.

Adapter section 40 actually isolates the weak point 35 on the draw rod 16 (i.e. on rod 14*a*) from any forces being applied through the workstring 23 while the setting tool is in a latched position. The load of the downhole assembly 100 is directly carried from workstring 23, through mandrel 14, collet fingers 42, to fishing neck 44 of the well tool 11. As set forth above, sleeve 50 is threaded onto rod 14*a* in such a manner so as to leave some clearance between the lower end of sleeve 50 and the upper internal surface of collet 41 (see FIG. 1). By so doing, draw rod 16 (i.e. mandrel 14 and rod 14*a*) effectively has a slip-joint therein and accordingly, can not be tensioned until the setting tool is actuated.

In operation, downhole assembly 100 is assembled with mandrel 14 of draw rod 16 being releasably latched to housing 27 of well tool 11 as shown in FIG. 1. In this first position, housing 12 of setting tool 10 is positioned (FIG. 1) so that shoulder 45 bears against fingers 42 of collet 41 to thereby maintain detents 43 into contact with the underside of fishing neck 44 on the body 27 of tool 11. Chamber 17, passage 20, and chamber 19 are filled with a non-compressible fluid (not shown) which prevents any movement between housing 12 mandrel 14 thereby latching the assembly in a first position (FIG. 1). Also, a shear pin(s) or the like (not shown) can be used to prevent premature relative movement between mandrel 14 and rod 14*a* as will be understood in the art.

Assembly 100 is then lowered on workstring 23 until it is properly positioned within a wellbore. If the assembly becomes stuck or needs to be retrieved before tool 11 is to be set, it can be retrieved by merely pulling up on the workstring 23. Since the draw rod is "unloaded", the lifting force of the workstring will be applied on well tool 11 mandrel 14 and the latched collet fingers 42 and not through the draw rod 16 as is the case in prior art assemblies of this type.

Once the assembly 100 is properly positioned within the wellbore, setting tool 10 is actuated to set tool 11. As shown, an electrical current will be transmitted down workstring 23 (i.e. e-line) to detonate the explosive charge 22 within chamber 17. Where an ordinary wireline comprises workstring 23, other techniques such as those discussed above may be used to detonate the charge 22. Setting tools using both e-lines and wirelines are well known in the art. Where regular tubing or coiled tubing is used for workstring 23, fluid merely can be pumped from the surface through the tubing and directly into chamber 19 to move piston 13, hence housing 12, downward to first release collet fingers 42 and then contact and initiate the setting of tool 11.

Where an exploding charge 22 is used, the gases resulting from the explosion force the piston 21 downward in chamber 17 which, in turn, forces the non-compressible fluid below the piston 21 through passage 20 and into chamber 19. This increase of fluid in chamber 19 acts on the piston 13 on housing 12 to force housing 12 downward with respect to mandrel 14 and workstring 23. As the lower end of housing 12 moves downward into contact with upper end of body 27 of well tool 11, the shoulder 45 moves out of contact with fingers 42 of collet 41. The downward movement of housing 12 against body 27 will cause slips 28 to move in relation to expanders 29 to initially set the slips 28 against the wall of the wellbore (i.e. well casing, not shown).

As housing 12 moves downward against body 27, mandrel 14 supports the well tool 11 through collet 41 until the collet fingers 42 are released at which time the upper and lower portions of draw rod 16 move into contact with each other and for the first time, the well tool becomes totally supported by draw rod 16. At this time, setting tool 10 is simultaneously pulling up on draw rod 16 (via piston 18) and pushing down on body 27 of well tool 11. These approximately equal and opposing forces continue to increase until any internal shear pins (not shown) in well tool 11 fail to release draw rod 16 and slips 28. The force begins to fall off as draw rod 16 and nose 26 move relative to the body 27 thereby forcing slips 28 outward on expanders 29 and into contact with the inner wall of the well casing (not shown) in the wellbore. This casing restricts further outward movement of the slips 28 and, hence the draw rod 16 and nose element 26, whereby the force builds as the setting tool 10 continues to stroke. At this point, the slips now will support tool 11 in the wellbore. The tensile force in the draw rod 16 and the opposing contact force on the body 27 continue to build, increasing the setting force in the slips 28 until the lower portion 14*a* of draw rod 16 fails at weak point 35. The setting force is retained in lower sheared portion of rod 14*a* and nose element 26 by locking ring 32 to thereby maintain tool 11 in the set position. The remainder of draw rod 16 (mandrel 14 and the upper broken part of rod 14*a*), adapter section 40 (collet 41), etc. can then be retrieved to the surface on workstring 23.

What is claimed is:

1. A downhole assembly for setting a well tool within a wellbore, said assembly comprising:

a setting tool; said setting tool having a draw rod wherein said draw rod is comprised of an upper portion and a lower portion which are slidably connected together to allow for relative movement therebetween; said upper portion adapted to be connected to a workstring for raising and lowering said downhole assembly in said wellbore;

a well tool which is to be set in said wellbore, and an adapter section connected to said setting tool having latch means for releasably latching said upper portion of said draw rod to said well tool to thereby prevent said relative movement between said upper and lower portions of said draw rod while in a latched position; and means for releasing said latch means when said assembly is in position within said wellbore to permit said relative movement whereby said upper portion of said draw rod can move into contact with said lower portion of said draw rod to provide lifting force from said workstring to said well tool through said draw rod.

2. The downhole assembly of claim 1 wherein said latch means comprises:

a collet having a plurality of fingers, said collet being attached to said upper portion of said draw rod, said fingers normally biased into contact with said well tool to releasably latch said well tool to said upper portion of said draw rod when in said latched position, and means for holding said fingers in said latched position during the positioning of said downhole assembly in said wellbore.

3. The downhole assembly of claim 2 wherein said setting tool comprises:

a housing in which said draw rod is slidably mounted, said lower portion of said draw rod being connected at its lower end to said well tool, said upper portion of said draw rod being connected at its upper end to the workstring; and means for moving said housing relative to said draw rod from a first position to a second position to actuate said setting tool.

4. The downhole assembly of claim 3 wherein said workstring comprises:

an e-line which extends to the surface.

5. The downhole assembly of claim 3 wherein said workstring comprises:

a wireline which extends to the surface.

6. The downhole assembly of claim 3 wherein said workstring comprises:

a string of tubing which extends to the surface.

7. The downhole assembly of claim 3 wherein said means for holding said fingers in said latched position comprises:

a collar on said housing which contacts said fingers to hold said fingers in said latched position when said housing is in said first position and which moves out of contact with said fingers when said housing is moved to said second position thereby releasing said fingers from said latched position.

8. The downhole assembly of claim 3 wherein said upper portion of said draw rod comprises:

a mandrel slidably mounted in said housing, and wherein said lower portion of said draw rod comprises:

a rod slidably connected to said mandrel for limited relative movement therewith.

9. The downhole assembly of claim 8 wherein said mandrel includes:

a piston thereon which is positioned within a chamber within said housing, said mandrel having chamber therein connected to said chamber in said housing; and a piston slidably mounted within said chamber within said mandrel to force fluid from said chamber within said mandrel into said chamber in said housing to move said housing from said first position to said second position.

10. The downhole assembly of claim 9 including:

an explosive charge in said chamber in said mandrel above said piston therein for actuating said piston.

11. A downhole assembly for setting a well tool within a wellbore, said assembly comprising:

a well tool to be set in a wellbore;

a setting tool, said setting tool comprising:

a housing;

a draw rod slidably mounted in said housing, said draw rod comprising:

an upper portion adapted to be connected at its upper end to a workstring; and a lower portion slidable connected at its upper end to the lower end of said upper portion for relative movement therewith and at its lower end to said well tool; and latch means for releasably latching said upper portion of said draw rod to said well tool to prevent said relative movement between said upper and lower portion of said draw rod until said setting tool is actuated.

12. The downhole assembly of claim 11 wherein said latch means comprises:

a collet having a plurality of fingers, said collet being attached to said upper portion of said draw rod, said fingers normally biased into contact with said well tool to releasably latch said well tool to said upper portion of said draw rod when said assembly is in a latched position, and means for holding said fingers in said latched position during the positioning of said downhole assembly in said wellbore.

13. The downhole assembly of claim 12 wherein said means for holding said fingers in said latched position comprises:

a collar on said housing which contacts said fingers to hold said fingers in said latched position when said housing is in said first position and which moves out of contact with said fingers when said housing is moved to said second position thereby releasing said fingers from said latched position.

14. The downhole assembly of claim 13 wherein said upper portion of said draw rod includes:

a mandrel slidably mounted in said housing, said mandrel having a piston thereon which is positioned within a chamber within said housing, said mandrel having chamber therein connected to said chamber in said housing; and a piston slidably mounted within said chamber within said mandrel to force fluid from said chamber within said mandrel into said chamber in said housing to move said housing from said first position to said second position.

* * * * *